US005700059A

United States Patent [19]

Moscot

[11] Patent Number: 5,700,059

[45] Date of Patent: Dec. 23, 1997

[54] BABY SUPPORT

[76] Inventor: Betty Lou Moscot, 11 Quaker Ridge Rd., Brookville, N.Y. 11545

[21] Appl. No.: 674,543

[22] Filed: Jul. 2, 1996

[51] Int. Cl.[6] ..... A47D 1/00

[52] U.S. Cl. ..... 297/452.17; 297/464; 5/655

[58] Field of Search ..... 297/1, 452.1, 452.17, 297/464, 467; 5/655

[56] References Cited

U.S. PATENT DOCUMENTS

| | | | |
|---|---|---|---|
| 2,281,629 | 5/1942 | Snow | 297/452.17 X |
| 2,710,052 | 6/1955 | Witmer | 297/452.17 X |
| 3,003,815 | 10/1961 | Zinn | 297/452.17 X |
| 3,271,028 | 9/1966 | Albin | 5/655 X |
| 4,862,535 | 9/1989 | Roberts | 5/655 |
| 5,372,405 | 12/1994 | Cash et al. . | |
| 5,395,154 | 3/1995 | Wang . | |
| 5,440,770 | 8/1995 | Nichols | 5/655 |

*Primary Examiner*—Peter R. Brown

*Attorney, Agent, or Firm*—Collard & Roe, P.C.

[57] ABSTRACT

A vertical baby support for simulating an ordinary holding position of a baby. A first inclined support receives, supports and retains a baby in a substantially vertical position. A cradle support holds the baby;s bottom while additional side straps provide further support of the baby against the inclined surface. A second support receives and supports the baby in a sitting position. A pair of side straps are releasably coupled to a center strap for securing the baby in the sitting position. Stabilizers are provided for preventing the accidental tipping of the baby holder when a baby is being supported therein.

10 Claims, 4 Drawing Sheets

BABY SUPPORT

BACKGROUND OF THE INVENTION

1. Field of the Invention

The present invention relates to baby holders. More particularly, it relates to an apparatus for holding a baby in a substantially vertical position to simulate a persons shoulder.

2. The Prior Art

U.S. Pat. No. 5,372,405 to Cash et al. discloses an adjustable flat-back floor sitter chair. The invention consist of a rectangular base plate formed with a trapezoidal leading edge, and a pair of parallel side walls extending upwardly from the parallel side edges of the base plate. The side walls are formed with longitudinal slots at various elevations parallel with the side edges of the base plate. The back plate has a lower edge in sliding contact with the upper surface of the base plate and having side edges in sliding contact with the interior faces of the side walls. The back plate is provided with a pari of outwardly projecting bolts extendable through the slots in the side walls with wing nuts for locking the bolts and back wall in a predetermined orientation along the length of the base plate.

U.S. Pat. No. 5,395,154 to Wang, discloses a foldable baby chair. The invention consists of a chair seat pivotally connected to the chair back via a pivot assembly. Inverted U-shaped guard rails are separately connected to the chair back and the chair seat by pivot assemblies, such that the U-shaped guard rails are allowed to pivot relative to the chair back or chair seat and can be positioned at different inclinations.

The prior art devices show several different kinds of baby support devices, all of which require the baby to be is a sitting position. When babies are being comforted by their parents or others, they are generally held supported against the holder's chest with their head resting on the holder's shoulder. During this comforting period, the general body position of the baby is a substantially vertical with respect to the ground.

Often times when the person holding the baby is finished, they return them to a sitting or lying position, and the baby starts to cry. Thus, there is a need for a device that can simulate a person's or mother's chest and shoulder for holding and supporting a baby in a substantially vertical position with respect to the ground.

SUMMARY OF THE INVENTION

The present invention provides a support device that simulates a persons chest and shoulder for purposes of holding and supporting a baby in a substantially vertical position.

According to the invention, the baby holder has a first support side that retains and supports a baby in a substantially vertical position. The vertical support surface is inclined and includes a cradle seat support for receiving the baby's bottom. An extra pair of fastening straps are used to further secure the baby to the inclined surface.

A second support side is provided for receiving and retaining a baby in a sitting position. A support strap on the sitting surface is positioned between the baby's legs, and is releasably attached to two side straps. When the baby is in the sitting position, they are secured in place by the support and side straps, while still retaining some freedom of motion from within the seat.

In alternative embodiments of the invention, rocking means are applied to the bottom of the baby holder for providing a limited rocking motion to the holder. Additional stabilization is also added to further prevent the possibility of accidental tipping of the baby holder while a baby is being supported therein. The additional stabilization can include weighting the bottom of the holder with weights, or may include increasing the bottom support surface area along the sides of the holder.

It is therefore an object of the present invention to provide an apparatus that supports and holds a baby in a substantially vertical position.

It is another object of the invention to provide an apparatus that simulates a mother's shoulder for holding and supporting a baby in a substantially vertical position.

A further object of the invention is to provide an apparatus that can be used to hold a baby in a substantially vertical position, and can also be used as a seat for holding the baby in a sitting position.

Yet another object of the invention is to provide a baby holding apparatus that operates more efficiently and reliably than the baby holders of the prior art.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
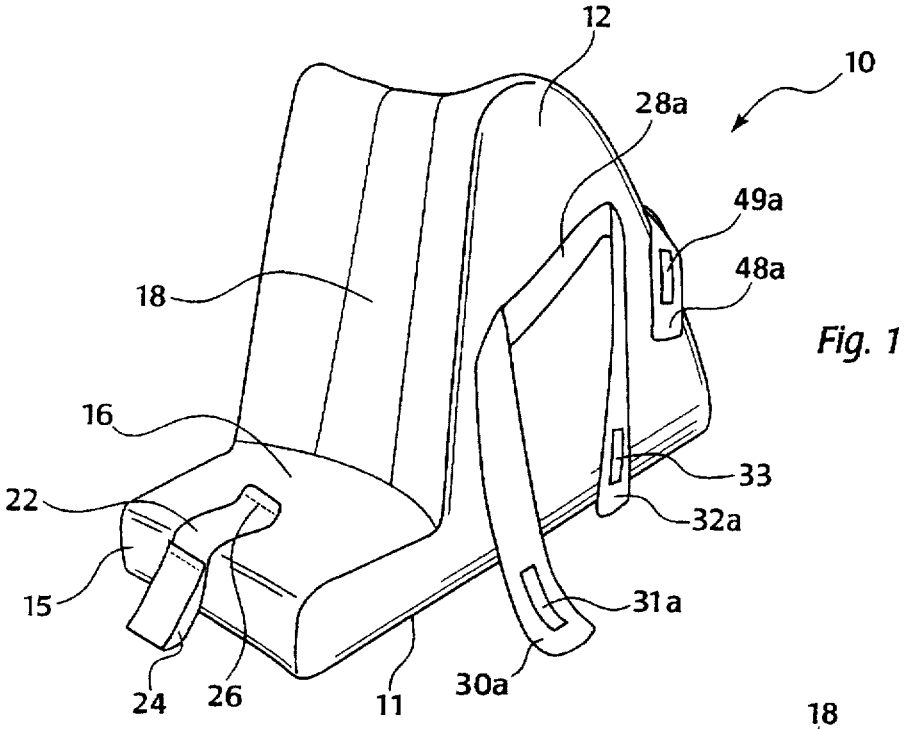
FIG. 1 is a front perspective view of the baby holder according to the invention.
Figure 2:
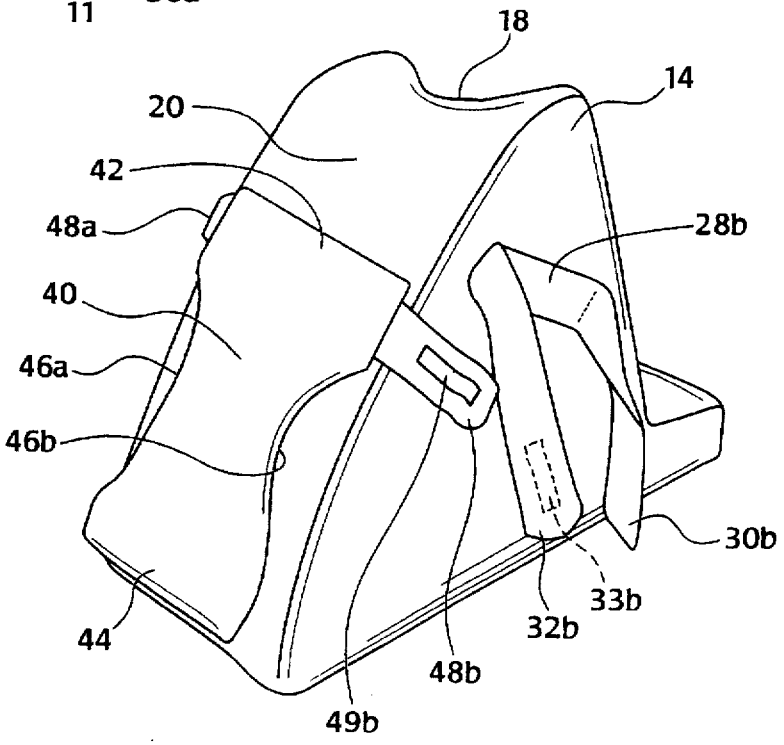
FIG. 2 is a rear perspective view of the baby holder according to the invention.

Turning now in detail to the drawings, FIGS. 1 and 2 show a first embodiment of the baby holder 10 according to the invention. Holder 10 has a bottom 11 that rests on a table or other stable structure, and has two baby supporting positions. On one side, an extension 15 creates a sitting surface 16 for receiving and supporting a baby in a sitting position. A back rest surface 18 provides back support for a baby disposed on sitting surface 16. Back rest surface 18 is preferably concave, but may be any suitable known shape for supporting a baby's back.

Holder 10 is made of a semi-rigid material, such as, foam rubber for providing sufficient structure support with a comfortable surface for engaging a baby's body. The semi-rigid material used may be any suitable known type of material capable of retaining its shape and supporting the weight of a baby. The body of holder 10 can be covered with a fabric or cloth material (not shown) to further enhance the body contact feeling. The fabric or cloth material is preferably removable so that the user can wash the fabric or cloth material without damaging holder 10.

Figure 3:
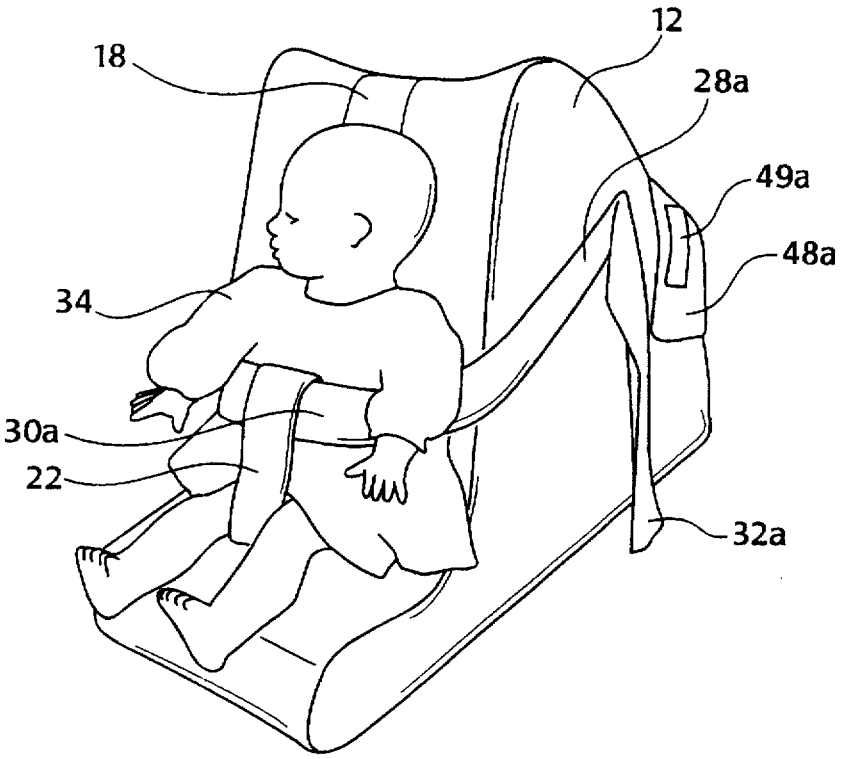
FIG. 3 is a front perspective view of the baby holder according to the invention with a baby secured therein.

A plurality of support straps 30*a*, 30*b*, 32*a*, and 32*b* are provided for retaining the baby in the respective support position. Straps 30*a* and 30*b* are used to secure the baby in the sitting position on sitting surface 16. FIG. 3 shows a baby 34 secured in the sitting position. Strap 22, which is attached to sitting surface 16 by stitching 26, includes a loop 24 for receiving straps 30*a* and 30*b*. Strap 22 is disposed between the baby's legs, and straps 30*a* and 30*b* pass through loop 24 and are releasably attached to each other to secure the baby in the sitting position. Straps 30*a* and 30*b* have a releasable fastener 31*a*, and 31*b*, respectively for securing the straps to each other. Fasteners 31*a* and 31*b* can be snap type fasteners, a hook and loop type fastener such as, for example, VELCRO®, or can be any other suitable known type of releasable fastener.

Figure 4:
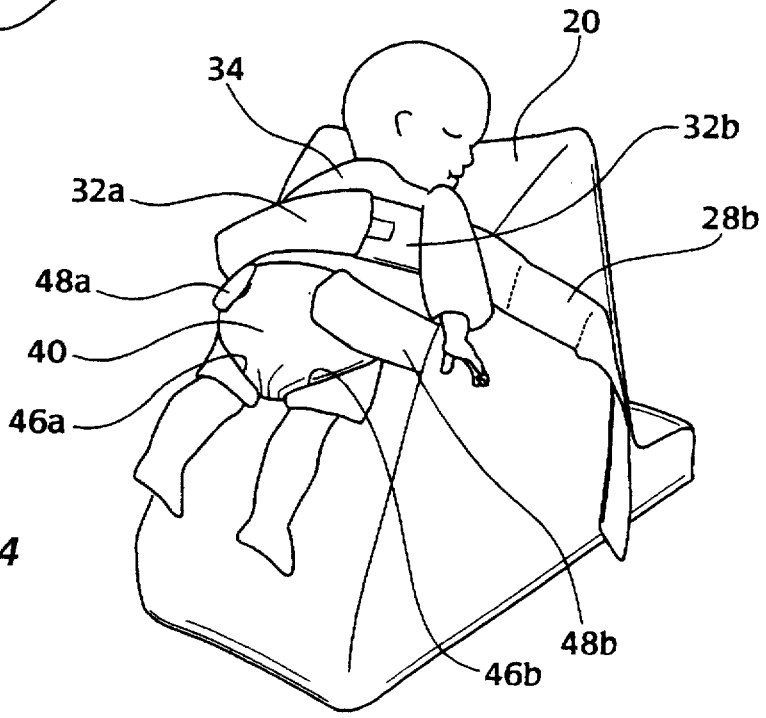
FIG. 4 is a rear perspective view of the baby holder according to the invention with a baby secured therein.

FIGS. 2 and 4 show the other side of holder 10 where baby 34 is supported and retained in a substantially vertical inclined position. Holder 10 has an inclined vertical support surface 20 with a vertical cradle seat support 40 for receiving the baby. Cradle seat support 40 has an upper portion 42 that is permanently affixed to support surface 20, a lower free end 44, and includes retaining straps 48*a* and 48*b*. When baby 34 is placed on support surface 20, as shown, lower end 44 of cradle seat support 40 is brought up underneath the baby such that the baby's legs are received by concave leg receiving sides 46*a* and 46*b* of the cradle support. Once lower end 44 is brought through the baby's legs, straps 48*a* and 48*b* are adhered to end 44 to retain baby 34 within cradle seat support 40 on inclined surface 20.

FIG. 4 shows baby 34 being supported by cradle support 40. Straps 48*a* and 48*b* have a releasable fastener 49*a* and 49*b*, respectively, (FIGS. 1 and 2) such as snaps or a hook and loop type fastener for providing a secure connection, and thereby safe support of cradle seat support 40 around the baby's bottom. Additional side straps 32*a* and 32*b* are wrapped around the baby's back, and underneath their arms to further secure baby 34 to inclined support surface 20. Straps 32*a* and 32*b* have a releasable fastener 33*a* and 33*b*, respectively, for releasably connecting the straps to each other.

Figure 5:
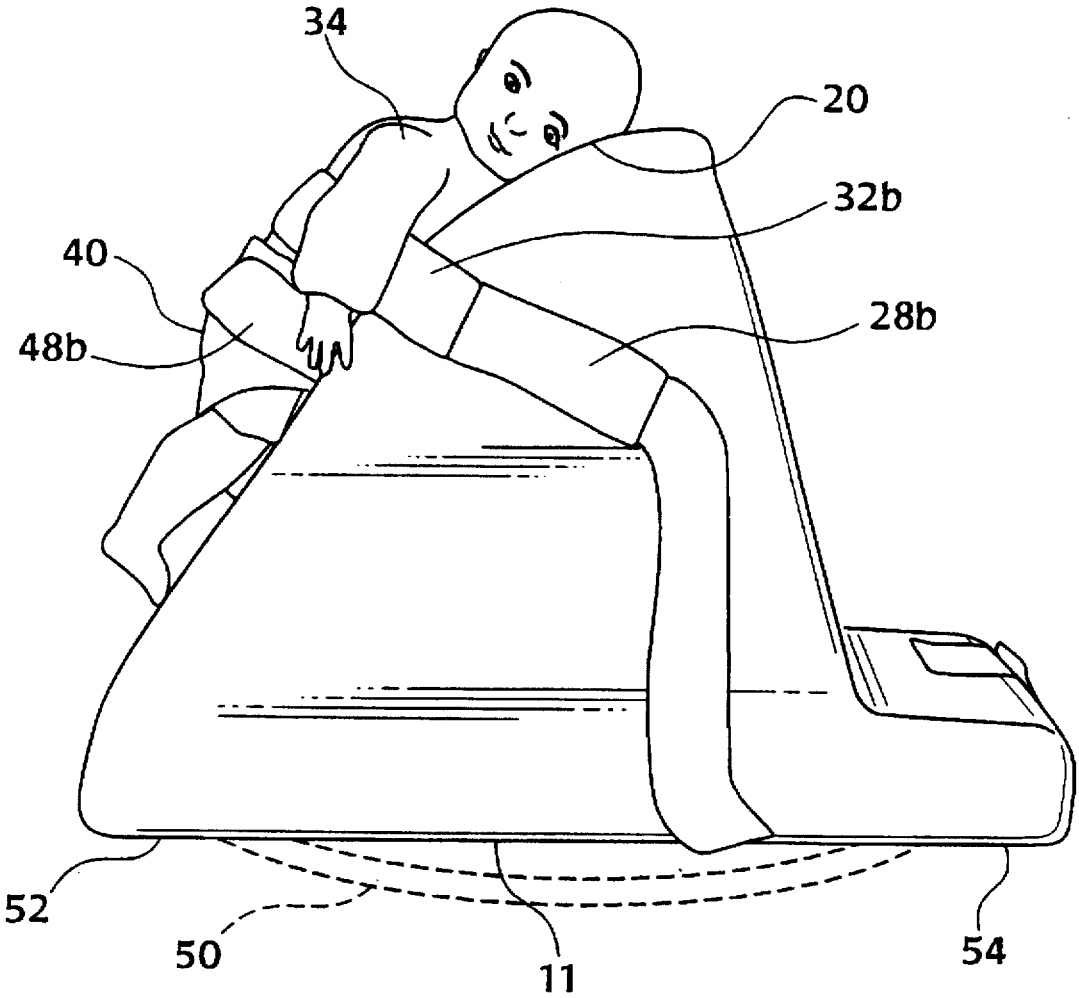
FIG. 5 is a side view of the baby holder according to the invention.

When baby 34 is secured in the inclined substantially vertical support position, the baby's head rests at the top of support surface 20, and their lower body extends along the inclined support surface (See FIG. 5). Inclined support surface 20 can have an angle of inclination with respect to bottom 11 in range of 45°–90°. Holder 10 is designed as an alternative to having a person hold the baby. Although holder 10 can be used for supporting a baby while they sleep, it's primary use is for supporting a baby during waking hours.

FIG. 5 shows an alternative embodiment of holder 10 with rockers 50 attached to the bottom. Rockers 50 allows holder 10 to be rocked with a limited rocking motion. Rockers 50 are centrally disposed along the bottom with respect to the front and back support surfaces of holder 10 such that portions 52 and 54 of bottom 11 act as built in stoppers to limit the rocking motion of the holder. Rockers 50 can be any suitable known rocking mechanism that can provide a limited or adjustable rocking motion.

Inclined support surface 20 is designed to simulate the ordinary holding position of a baby by their mother or other person. When holding a baby in this position, the holder usually supports the baby's bottom and the baby can rest against the holder's chest and shoulder. Inclined support surface 20 simulates a human holders chest and shoulder. In an additional embodiment, not shown, holder 10 can include an internal electronic device that simulates a heartbeat or breathing cadence so as to further simulate a human holder.

Figure 6:
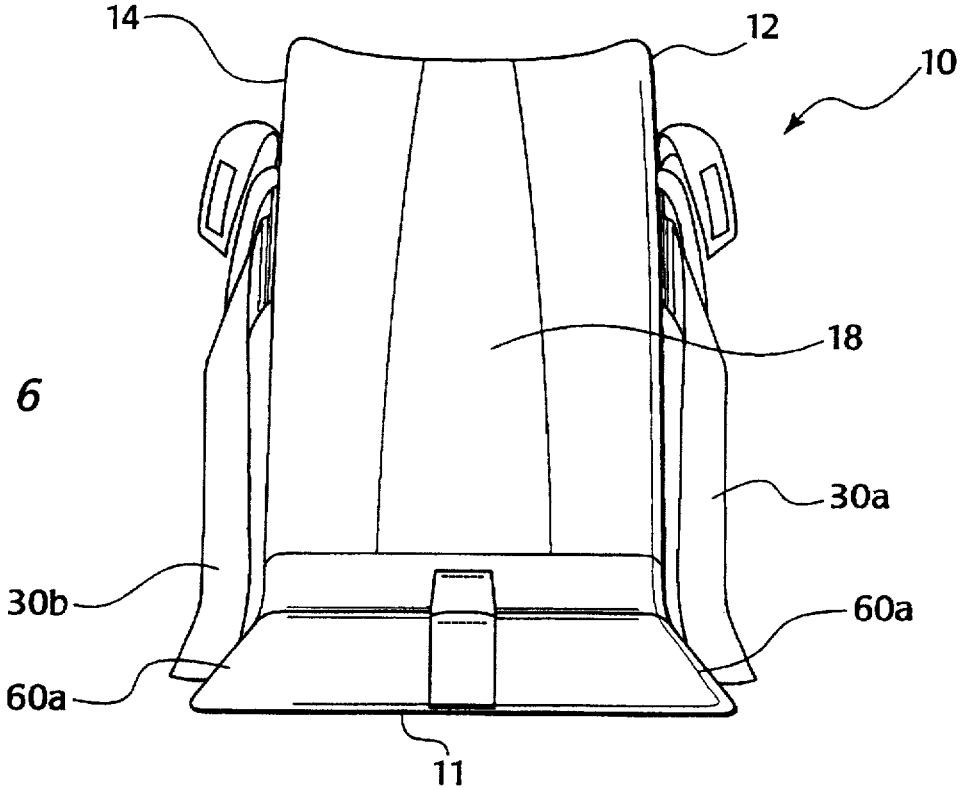
FIG. 6 is an elevational view of a second embodiment of the baby holder according to the invention.
Figure 7:
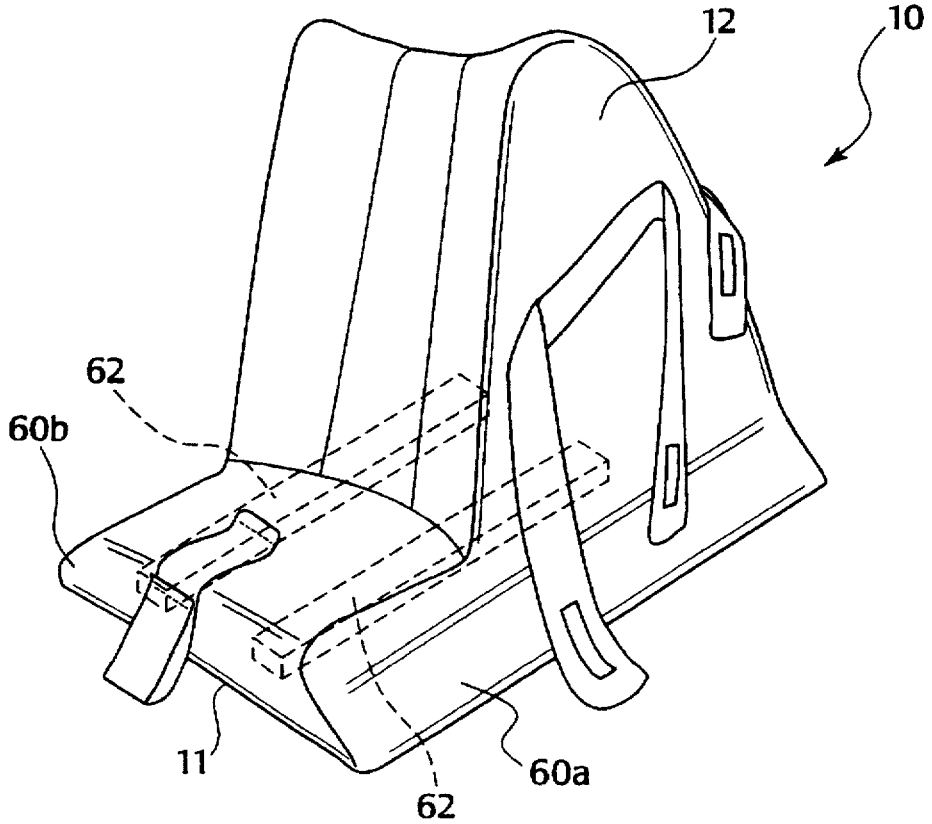
FIG. 7 is a perspective view of the second embodiment of the baby holder according to the invention.

FIGS. 6 and 7 show a second embodiment of holder 10 according to the invention. Holder 10 has additional stabilization supports 60*a* and 60*b* that extend along the entire length of the bottoms of sides 12 and 14. Stabilization supports 60*a* and 60*b* are flared outward extensions that increase the bottom surface area of holder 10. Thus, supports 60*a* and 60*b* prevent the accidental tilting of holder 10 which can be caused by a baby trying to move from a secure supported position.

FIG. 7 also shows another form of stabilization using weights 62. Weights 62 can be any size or shape, and are preferably disposed within holder 10 near the bottom thereof. By weighting the bottom of holder 10, the center of gravity of the holder is lowered toward the surface on which the holder is being supported, and thus is inherently more stable. Weights 62 can be used in any of the embodiments shown.

While several embodiments of the present invention have been shown and described, it is to be understood that many changes and modifications may be made thereunto without departing from the spirit and scope of the invention as defined in the appended claims.

What is claimed is:

1. A baby support apparatus for supporting and holding a baby comprising:

a base portion having front and back surfaces, a pair of opposite sides, and a bottom support surface;

said front surface being inclined between 45°–90° with respect to said bottom surface for holding and supporting a baby in a first downwardly-facing support position;

first fastening means coupled to said base portion for releasably securing the baby on said front surface in a first support position;

a chair disposed on said back surface of said base portion for holding and supporting a baby in a sitting position, said chair comprising a seat extending outward from and integrally formed with said base portion, and a back rest formed by said back surface and extending upward from said seat; and second fastening means coupled to said seat for releasably securing the baby in the chair in a sitting position.

2. The baby support according to claim 1, further comprising:

a cradle support having a first end coupled to said inclined front surface of said base portion, a second opposite free end, and two sides connecting said first and second ends, said sides being concave and forming leg receiving areas when said second end is aligned with said first end; and a first securing strap coupled to each side of said first end of said cradle support, each of said securing straps having a free end for releasably coupling to said second end of said cradle support when a baby is being supported therein.

3. The baby support according to claim 1, wherein said first fastening means comprises a second securing strap coupled to each of said sides of said base portion, each of said second securing straps having a free end for extending over said front surface when a baby is supported in said cradle support, said free ends being releasably coupled to each other to further secure the baby within said cradle support.

4. The baby support according to claim 3, wherein said free ends of said first and second securing straps include snap type fasteners.

5. The baby support according to claim 3, wherein said free ends of said first and second securing straps include hook and loop type fasteners.

6. The baby support according to claim 1, wherein said chair comprises:

an extension of a lower portion of said back surface, said extension having an upper surface parallel to said bottom surface of said base portion, said upper surface defining a sitting surface, the remaining portion of said back surface defining a back rest;

a seat support centrally disposed and coupled to said sitting surface;

securing straps coupled to said sides of said base portion, said securing straps having free ends for engaging said seat support and each other to releasably secure the baby in the sitting position.

7. The baby support according to claim 1, further comprising stabilization means incorporated into said base portion for preventing tipping of the support while supporting a baby.

8. The baby support according to claim 7, wherein said stabilization means comprises an extension of the bottom surface of said base portion from said opposite sides for increasing the area of said bottom surface.

9. The baby support according to claim 7, wherein said stabilization means comprises weights disposed within said base portion near said bottom surface.

10. The baby support according to claim 1, further comprising rocking means attached to said bottom of said base portion for providing a limited rocking motion to the support.

* * * * *